United States Patent [19]

Nagamoto et al.

[11] Patent Number: 4,532,487

[45] Date of Patent: Jul. 30, 1985

[54] RELAY STRUCTURE

[75] Inventors: Mitsuki Nagamoto; Takuo Kubota, both of Mie, Japan

[73] Assignee: Matsushita Electric Works, Ltd., Osaka, Japan

[21] Appl. No.: 583,384

[22] Filed: Feb. 24, 1984

[30] Foreign Application Priority Data

Feb. 28, 1983 [JP] Japan ..... 58-32339
May 31, 1983 [JP] Japan ..... 58-82363

[51] Int. Cl.[3] ..... H01H 45/02

[52] U.S. Cl. ..... 335/128; 335/203; 335/106

[58] Field of Search ..... 335/106, 107, 128, 135, 335/203

[56] References Cited

U.S. PATENT DOCUMENTS 4,227,162 10/1980 Fujita et al. ..... 335/106

*Primary Examiner*—E. A. Goldberg
*Assistant Examiner*—George Andrews
*Attorney, Agent, or Firm*—Stevens, Davis, Miller & Mosher

[57] ABSTRACT

A relay structure advantageous for compacting purpose is disclosed herein. The relay comprises a generally L-shaped yoke having an upright yoke leg and an upper yoke member extending substantially at a right angle thereto, the upright yoke leg being connected to one end of the core of an energizing coil which extends substantially in parallelism with said upper yoke member. The upper yoke member is formed with a center slot extending longitudinally thereof to be open at both longitudinal ends. A generally L-shaped armature is hingedly supported onto the free end of the upper yoke member with a tab extending across the air gap defined between the free end of the upper yoke member and the opposite end of the core. Extended from the upper end of the tab is an actuator arm which is received in said slot and on which overlies a spring blade carrying at its free end a movable contact. Upon hinging movement of the armature in one direction in response to the coil being energized, the actuator arm presses upwardly the spring blade to engage or disengage the movable contact from a cooperating fixed contact. Conversely, when the coil is deenergized the armature is driven to hinge in the opposite direction by the biasing force from the spring blade to disengage or engage the movable contact with the fixed contact.

3 Claims, 9 Drawing Figures

RELAY STRUCTURE

BACKGROUND OF THE DISCLOSURE

1. Fields of the Invention

This invention is directed to a relay structure, more particularly to a relay structure having a generally L-shaped armature pivotally supported by a yoke.

2. Description of the Prior Art

In prior relays having an armature pivotally supported by a yoke, there have been a wide variety of improvements in simplifying a relay structure to effectuate a compact arrangement. One of the improvements is schematically illustrated in FIG. 1, in which a generally L-shaped armature 4 formed of a tab 4*a* and an actuator arm 4*b* is pivotally supported at its corner on the free end of a generally L-shaped yoke 3. Attached onto and overlying the actuator arm 4*b* is a contactor blade 5 which carries at its one end a movable contact 6 at the same time biases the armature 4 in the direction of releasing the tab 4*a* from one end of a core 2 such that the armature 4 hinges about a hinge axis in the direction of engaging the movable contact 6 with one of cooperating fixed contacts 7 when a solenoid winding 1 about the core 2 is energized and conversely that the armature 4 hinges in the opposite direction to disengage the movable contact 6 from that fixed contact 7 when the coil 1 is deenergized. With this arrangement, the contactor blade 5 can also serve as a restoring spring to disengage the movable contact 6 from the fixed contact 7 when the coil 1 is deenergized, eliminating any additional spring means and thus enabling a simplified structure. However, in the above relay structure, the actuator arm 4*b* for actuating the contactor blade 5 is required by its structural limitation to be located above the horizontal member 3*b* of the yoke 3, and accordingly the actuator arm 4*b* will certainly be the cause of adding the thickness or the height to the overall relay assembly, failing to fully satisfy the requirement of reducing as much as possible the height of the relay assembly.

SUMMARY OF THE INVENTION

The present invention has been accomplished in view of the above and eliminates the disadvantage associated with the above described prior art relay. A relay structure in accordance with the present invention includes a generally L-shaped yoke formed of an upright yoke leg and an upper yoke member extending generally horizontally from the upper end of the leg. The upper yoke member is provided with a center slot which extends longitudinally of the member to be open at both longitudinal ends and defines on both sides thereof lateral side segments. An energizing coil having a solenoid winding about a core extending in substantially parallel relationship with said upper yoke member is linked to the yoke with the one end of the core being connected to the upright leg. Cooperating with the yoke and the coil is a generally L-shaped armature comprising a tab and an actuator arm to have at its corner a hinge axis by which the armature is hingedly supported on the free end of the upper yoke member to be movable between two positions for effecting a relay operation in response to the coil being energized and deenergized, the tab extending across the air gap defined between the opposite end of the core and the free end of the upper yoke member and the actuator arm extending through said slot in the upper yoke member of the yoke. An electrically conductive thin contactor plate is secured on the upper yoke member. Integrally formed with said contactor plate is a center spring blade which has at its free end a movable contact and at the same time overlies said actuator arm to bias it in the direction of disengaging the movable contact from a cooperating fixed contact. During the hinging movement of the armature between the positions of engaging and disengaging the movable contact with and from the fixed contact, said actuator arm is kept substantially within the slot in the upper yoke member, whereby the thickness of the actuator arm can be received within the upper yoke member, reducing the thickness or height of the overall relay assembly. With this result, a reduced height of the relay can be obtained under the retention of providing a simplified relay structure which arises from the employment of the contactor plate having in situ the functions of exerting the restoring force to the armature and of carrying the movable contact.

Accordingly, it is a primary object of the present invention to provide a relay structure which allows the relay to be constructed in a greatly reduced thickness or height as well as in simplified arrangement.

In connection with the above, there introduced an advantageous construction feature to retain the actuator arm substantially within said slot in the yoke. The lateral side segments formed on both sides of said slot are provided at the respective free end portions with aligned prongs which extend downwardly and outwardly to receive thereon respective hinge pins extending sideward from the upper end portion of said tab of the armature, whereby the armature to be hingedly supported on the free end of the yoke is prevented from unduly projecting above the plane including the upper surface of the yoke.

It is therefore another object of the present invention to provide a relay structure in which the armature is successfully supported by the yoke in such a manner as to give rise to said compact arrangement.

In a preferred embodiment of the present invention, said hinge pins are formed to be of the cross section having an edged corner defining said hinge axis about which the armature hinges. Thus, the edged corner serves as a fulcrum abutting on the projections of the yoke at a fixed point, preventing undesirable shifting of the hinge axis during the relay operation.

It is therefore a further object of the present invention to provide a relay structure which effectuates a stable hinging movement of the armature to assure accurate switching operation of the relay.

These and still other objects of the present invention will be more apparent from the following detailed description in conjunction with the attached drawings.

DETAILED DESCRIPTION OF THE EMBODIMENT

Figure 1:
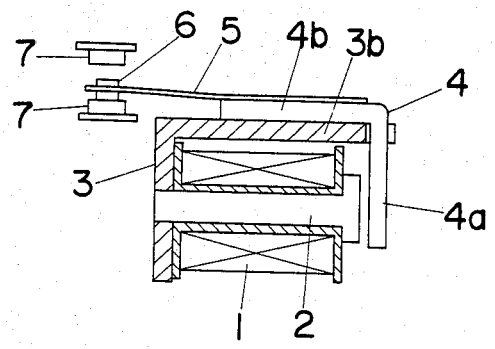
Fig. 1 (PRIOR ART)
FIG. 1 is a longitudinal sectional view in greatly schematic representation of a prior art relay.
Figure 2:
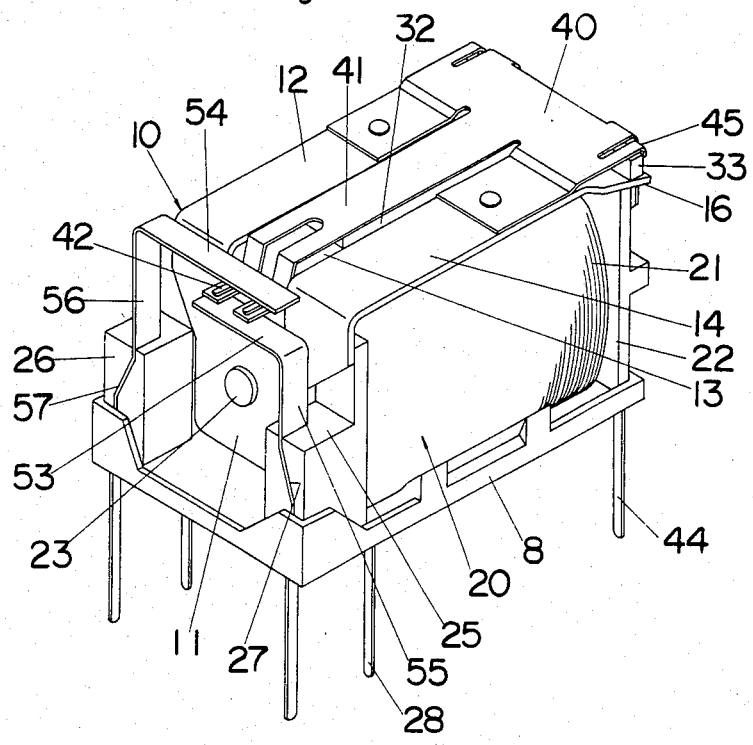
FIGS. 2 and 3 are respectively perspective views from different directions of a relay with its cover being removed in accordance with a preferred embodiment of the present invention.
Figure 3:
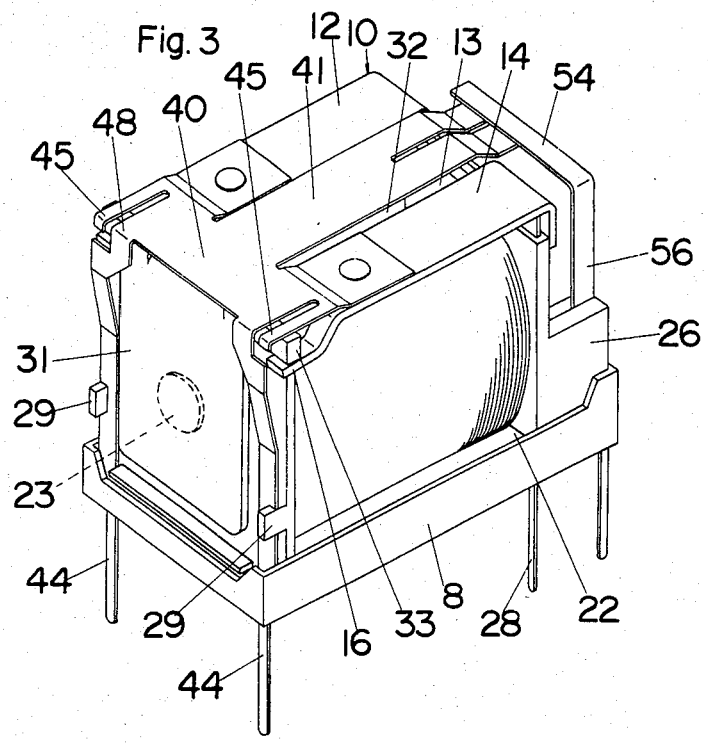
Figure 4:
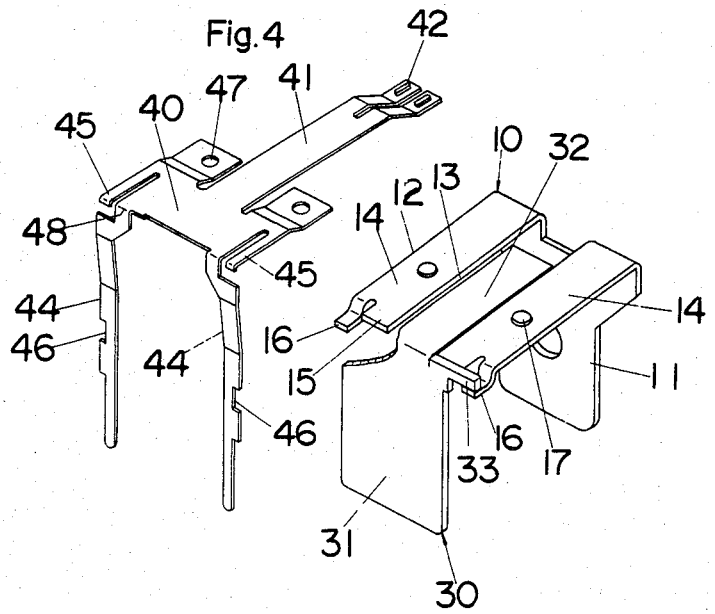
FIG. 4 is an exploded perspective view partly being cut away showing a yoke and armature employed in the above relay.

Referring firstly to FIGS. 2 and 3, there is shown a relay in accordance with a preferred embodiment of the present invention. The relay is of the type having a single-pole double-throw contact arrangement and comprises a generally L-shaped yoke 10 mounted on a base 8 and an energizing coil 20 including a solenoid winding 21 supported by a bobbin 22 through which a core 23 extends, the bobbin 22 being fixedly mounted on the base 8 to hold the coil 20 in position. The yoke 10 has an upright yoke leg 11 to which one end of the core 23 is connected and an upper yoke member 12 extending from the upper end of the leg 11 to be parallel with the coil 20, the connection between the upright yoke leg 11 and the core 23 being such that an air gap is defined between the opposite end of the core 23 and the free end of the upper yoke member 12 as well as that the yoke 10 is fixedly mounted on the base 8 by means of said bobbin 22. As best shown in FIG. 4, the upper yoke member 12 is formed with an elongated center slot 13 which extends the entire length thereof to have at its both longitudinal ends respective openings in such a way as to divide the upper yoke member 12 into lateral side segments 14 parallel with one another. Each free end of the lateral side segments 14 is bifurcated to form a straight extension 15 and a downwardly and outwardly extending prong 16, said extension terminating at a point displaced backwardly of the tip of the prong 16 and being shaved to provide a slanted end face. Cooperating with the yoke 10 is an armature 30 of generally L-shaped configuration composed of a tab 31 and an actuator arm 32 extending from the upper end of the tab 31 at a right angle thereto. A pair of opposed and horizontally aligned hinge pins 33 extend sideward from the upper end of the tab 31 to rest on the respective prongs 16 of the yoke 10 in such a manner as to hingedly support the armature 30 on the free end of the upper yoke member 12, so that the tab 31 extends across said air gap and at the same time the actuator arm 32 is received within said slot 13 in the upper yoke member 12. A cover 9 enclosing the components on the base 8 is hermetically attached to the base 8 as shown in FIGS. 5, 7 and 8.

A thin contactor plate 40 made of electrically conductive material is disposed on the upper yoke member 12 with the side portions being riveted respectively to said lateral side segments 14 of the upper yoke member 12 so as not unduly add the thickness to the upper yoke member 12. A rivet 17 integral on each lateral side segments 14 of the yoke 10 is staked to a corresponding hole 47 in each side portion of the contactor plate 40 for securing the contactor plate 40 onto the upper yoke member 12. Integrally formed with and extending in substantially the same plane of the contactor plate 40 is a center spring blade 41 which overlies said actuator arm 32 to bias the same downwardly and goes beyond it to carry a movable contact 42 at its extended portion. Also integrally formed with the contactor plate 40 are a pair of terminal legs 44 which extend downwardly from the rearward sides thereof to pass downwardly through the base 8, serving as common terminals. Further, the contactor plate 40 is formed at its lateral sides with integral retaining lugs 45 which extend rearwardly in substantially the same plane of the plate 40 but have their free end portions slightly bent downwardly to hold down said hinge pins 33 on the corresponding prongs 16 so as to retain them in position.

Figure 5:
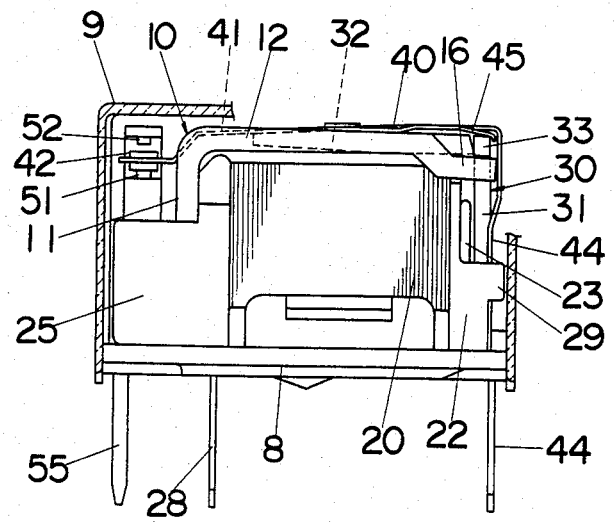
FIG. 5 is an elevational view of the above relay partly in cross section.
Figure 6:
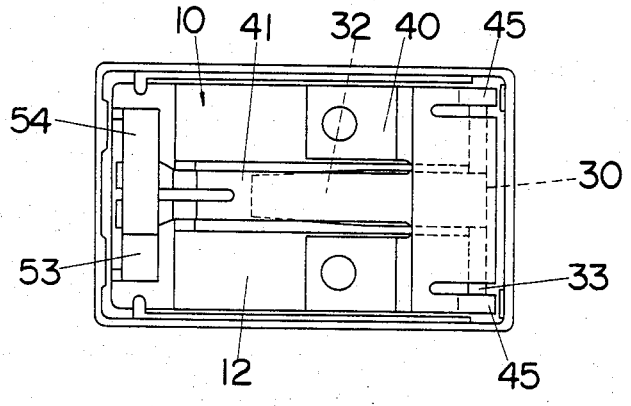
FIG. 6 is a top view of the above relay with the cover removed.
Figure 7:
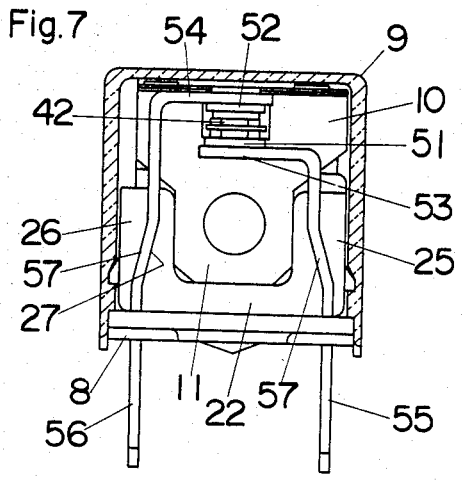
FIG. 7 is a left side view of the above relay partly in cross section.
Figure 8:
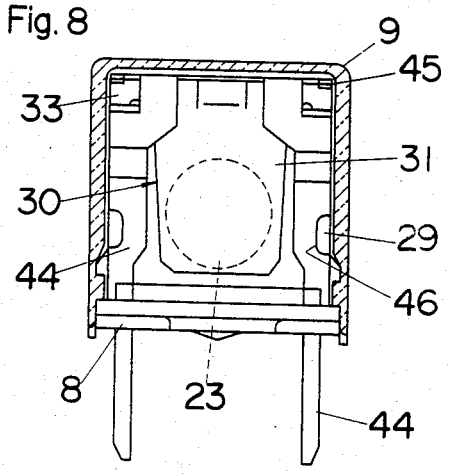
FIG. 8 is a right side view of the above relay partly in cross section.

As shown in FIGS. 2, 5 and 7, said movable contact 42 carried on the free end of the center spring blade 41 cooperates with first and second fixed contacts 51 and 52 disposed respectively on horizontal strips 53 and 54 so as to constitute a contact structure. The horizontal strips 53 and 54 have downwardly extending terminal legs 55 and 56 which are fixedly supported by means of blocks 25 and 26 integrally molded with the bobbin 22 on the base 8 in such a way as to locate the contact structure within the height of the yoke 10 or the upright yoke leg 11. Said terminal legs 55 and 56 extend downwardly through the base 8, serving respectively as NC and NO terminals. That is, the first fixed contact 51 connected to the terminal leg 55 is in contacting engagement with said movable contact 42 at a normal condition where the coil 20 is deenergized, while the second fixed contact 52 connected to the terminal leg 56 is brought in contacting engagement with the movable contact 42 at an energized condition. Each of the above terminal legs 55 and 56 is twice bent intermediate its ends to form an oblique portion 57 thereat which is snugly inserted in a correspondingly curved zig-zag groove 27 as best shown in FIG. 7, whereby each of strips carrying the first and second fixed contact 51 and 52 is prevented from slacking so as to provide stable and accurate positioning of the contacts. A pair of coil terminals 28 connecting across the opposite ends of the solenoid winding 21 extend through the base 8 to receive an energizing current.

In operation, when the coil 20 is deenergized not to produce an attracting force between the tab 31 and the core 23, the acutator arm 32 is biased downwardly by the center spring blade 41 to engage the movable contact 42 with first fixed contact 51 and disengage it from the second fixed contact 52, as best shown in FIG. 5. Conversely, when the coil 20 is energized to attract the tab 31, the armature 30 hinges to press the center spring blade 41 up against the biasing force thereof so as to disengage the movable contact 42 from the first fixed contact 51 and simultaneously engage it with the second fixed contact 52. During this hinging movement of the armature 30, the acutator arm 32 is kept substantially within the slot 13 in the upper yoke member 12 with possible exception that the outermost portion of the acutator arm 32 at the time of the coil 20 energized may slightly project above the plane including the upper surface of the upper yoke member 12 but does not project beyond the rear end of the contactor plate 40. This enables the actuator arm 32 of the armature 30 to be received in the upper yoke member 12, effectuating a compact arrangement for the combination of the yoke 10 and the armature 30 with respect to the height thereof.

Figure 9:
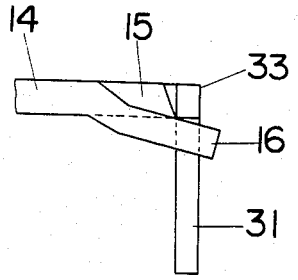
FIG. 9 is a partial view showing the portion at which the armature is hingedly supported on the yoke.

Referring to FIGS. 3 and 9, each of said hinge pins 33 has the square cross section to have an edged corner defining a hinge axis or fulcrum which rests on the corresponding prong 16 of the upper yoke member 12 at a predetermined point by the help of said retaining lug 45, such that the armature 30 hinges about a fixed point to assure stable and accurate operation.

As illustrated in FIGS. 3, 4 and 8, each of said terminal legs 44 extending downwardly from the contactor plate 40 is bent at the intermediate portion to present the inherent resiliency in the direction of thickness thereof, whereby the each terminal leg 44 is urged to have close abuttment with a corresponding hole (not shown) through which it extends downwardly of the base 8, ensuring firm connection of each terminal leg 44 to the base 8. In addition, each terminal leg 44 is formed at the intermediate portion with a notch 46 into which a projection 29 from said bobbin 22 extends to hold the leg. This is advantageous for easy assembling operation of the terminal legs 44 in the base 8 wherein the contactor plate 40 is firstly secured to the yoke 10 and thereafter the terminal legs 44 are inserted in the corresponding holes in the base 8 by bending the same at 48 in such a manner as to engage the notches 46 with the projections 29.

In the embodiment described above, the slot 13 in the upper yoke member 12 is designed to be in the form of a slit, but the present invention should not limited to this aspect and the slot may be in the form of a groove in the upper yoke member having a depth enough for receiving the actuator arm of the armature. The above description and particularly the drawings are set forth for purposes of illustration only. It will be understood that many variations and modifications of the embodiments herein described will be obvious to those skilled in the art, and may be carried out without departing from the spirit and scope of the invention.

What is claimed is:

1. A relay structure comprising in combination:

a generally L-shaped yoke comprising an upright yoke leg and an upper yoke member substantially at right angle thereto, said upper member being formed with a longitudinally extending slot which is open at both longitudinal ends and divides the upper yoke member into lateral side segments;

an energizing coil including a solenoid winding on a core which is disposed below said upper yoke member in substantially parallel relationship therewith, one end of the core being connected to said upright yoke leg;

a generally L-shaped armature comprising a tab confronting the other end of the core and an actuator arm extending through said slot and having at its corner a transverse hinge axis by which the armature is hingedly supported onto the free end of the upper yoke member;

a relatively thin contactor plate made of electrically conductive material secured onto the upper yoke member and having a center spring blade extending integrally therefrom to overlie said actuator arm of the armature to bias it downwardly; and a contact structure comprising a movable contact carried on the free end of said central blade and at least one fixed contact to be in engageable arrangement with the movable contact, said contact assembly located within the height of said yoke;

said center spring blade biasing the armature in the direction of releasing the tab away from the core, whereby in response to the coil being energized the armature hinges about said hinge axis against the biasing force of the center blade in one direction to press the center spring blade up for engaging the movable contact with the fixed contact and in response to the coil being deenergized the armature hinges in the opposite direction by that biasing force to disengage the movable contact from the fixed contact, and said actuator arm being received substantially within the depth of said slot in the upper yoke member during the hinging movement of the armature.

2. A relay structure as set forth in claim 1, wherein said armature is formed at the upper end portion of the tab with opposed sideward projecting hinge pins defining said hinge axis, and wherein said lateral side segments are respectively formed at its free end portion with outwardly and downwardly extending prongs for receiving thereon said hinge pins.

3. A relay structure as set forth in claim 2, wherein said hinge pins have a cross section with an edged corner which defines said hinge axis or fulcrum whereby the armature is supported on said prongs with said edged corner being in abutting engagement with a fixed point on the corresponding prongs.

* * * * *